United States Patent [19]

Gray, Jr.

[11] Patent Number: 4,517,570

[45] Date of Patent: May 14, 1985

[54] METHOD FOR TUNING A PHASED ARRAY ANTENNA

[75] Inventor: Roger P. Gray, Jr., Sykesville, Md.

[73] Assignee: The United States of America as represented by the Secretary of the Air Force, Washington, D.C.

[21] Appl. No.: 471,550

[22] Filed: Mar. 2, 1983

[51] Int. Cl.[3] ..... H01Q 3/00

[52] U.S. Cl. ..... 343/372

[58] Field of Search ..... 343/703, 853, 371, 372

[56] References Cited

U.S. PATENT DOCUMENTS 3,357,017 12/1967 Jewell ..... 343/703

*Primary Examiner*—Eli Lieberman

*Attorney, Agent, or Firm*—Donald J. Singer; Bernard E. Franz

[57] ABSTRACT

During installation or maintenance of a phased array antenna system in which the transmission line to each element includes an adjustable phase shift device, it is required that the effective electrical lengths of the lines be adjusted to be equal, or alternatively that the phase errors be determined and stored as correction data for use during normal operation. One way of doing this is to phase modulate by ±90° the phase shift device of one element at a time, while applying a test signal to all elements. The signal is radiated by the array, received via a test antenna, and supplied to an envelope detector. If the element is out of tune, the envelope has different amplitudes at +90° and −90° of the modulation. The element is tuned by adjusting the length of its transmission line or the adjustment of its phase shift device to obtain a null at the amplitude detector.

In an improved technique, to reduce certain errors, sum tuning is used, in which the ±90° phase modulation is applied to all of the phase shift devices, except for that of the element being tuned.

4 Claims, 10 Drawing Figures

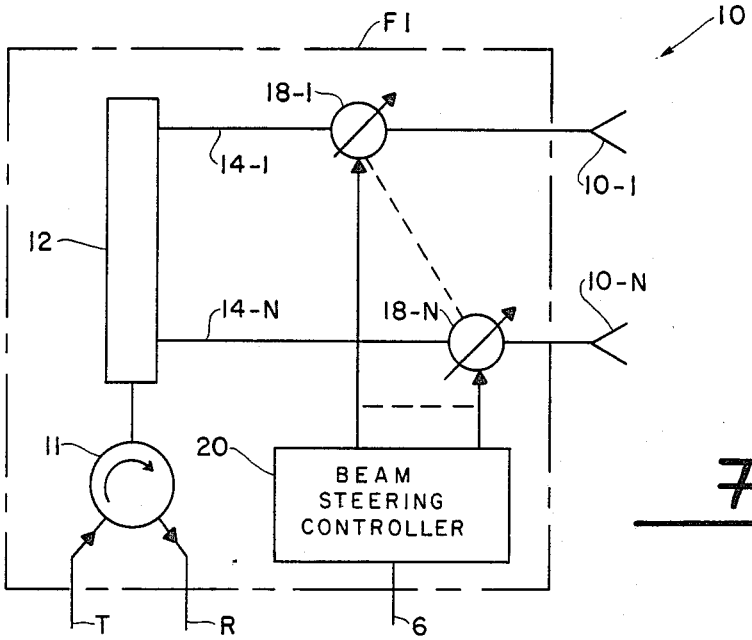
Fig. 1
Fig. 3
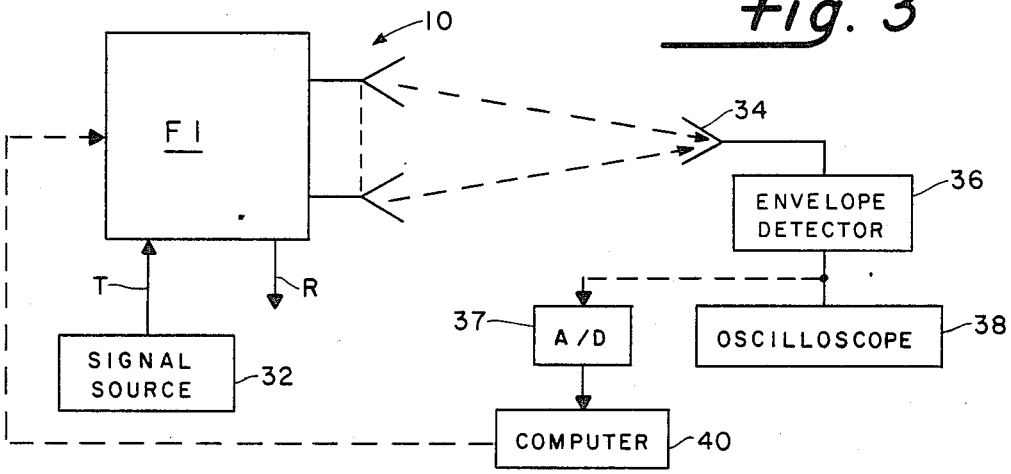
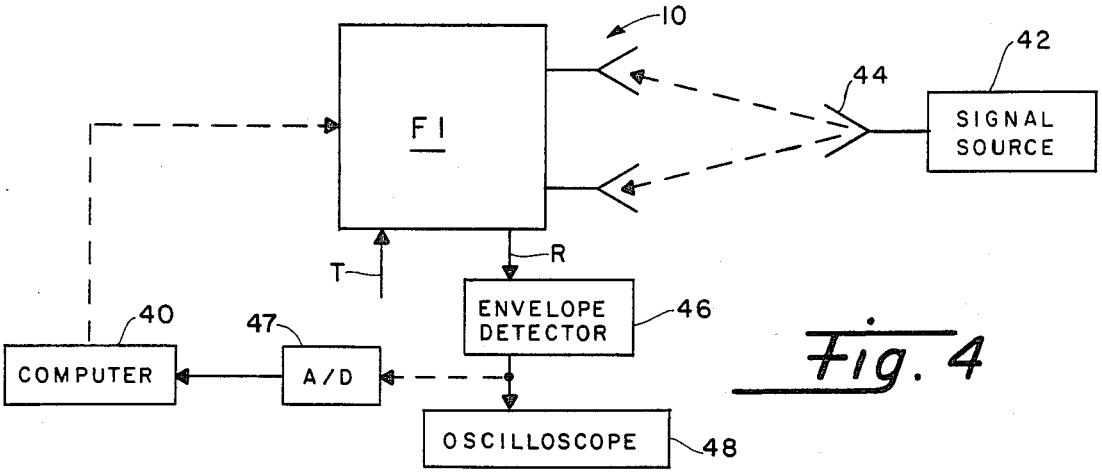
Fig. 4

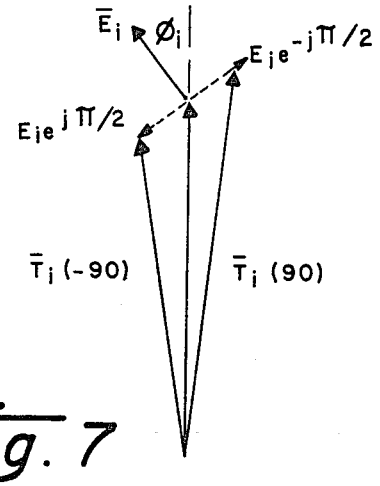
Fig. 7
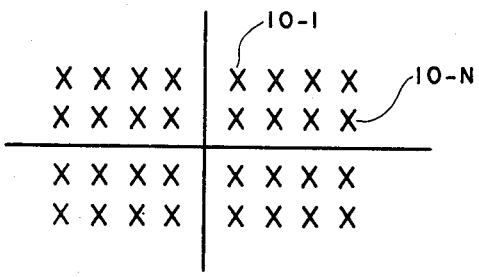
Fig. 2
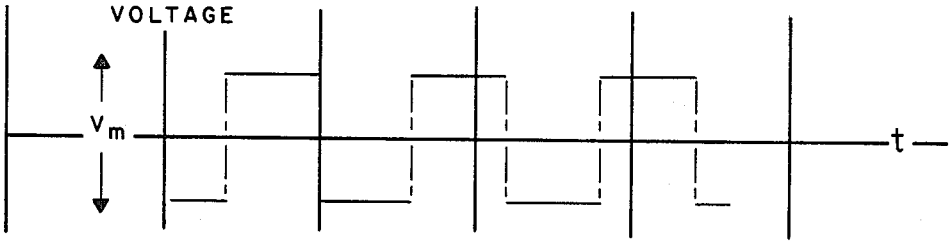
Fig. 8
Fig. 9
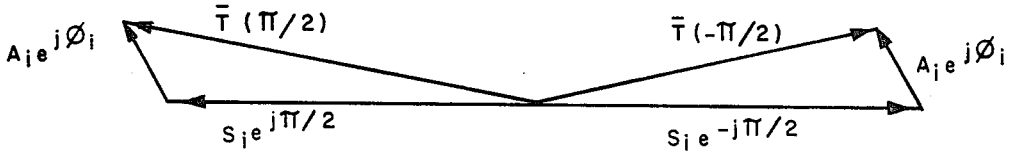
Fig. 10
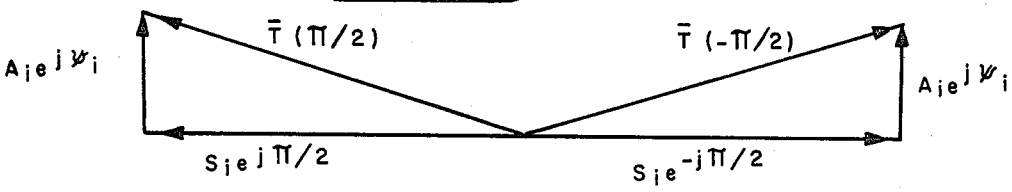

METHOD FOR TUNING A PHASED ARRAY ANTENNA

RIGHTS OF THE GOVERNMENT

The invention described herein may be manufactured and used by or for the Government of the United States for all governmental purposes without the payment of any royalty.

BACKGROUND OF THE INVENTION

This invention relates to a method for tuning a phased array antenna, and more particularly to a method of adjusting for differences in the effective lengths of the transmission lines to the elements of a phased array.

Phased array antenna systems are well known, one application being electronic steering of a beam for a tracking radar system. In such a system, the transmission line for each radiator element of the antenna includes a phase shift device which is controlled by a beam-steering computer. To provide a flat phase front under normal radiating conditions and maximize antenna bandwidth, the line lengths to each radiator element must be equal (or within other specified design) to within a few electrical degrees. Since this accuracy cannot be maintained in manufacturing, this may be accomplished in a "tuning" procedure by adjusting the line lengths, or by measuring the error and storing the value for use by the steering computer. There are a number of problems associated with equalizing line lengths and phase shifts.

Representative phased array systems are shown in U.S. patents to Kaiser, Jr., U.S. Pat. No. 4,213,131, Williams et al. U.S. Pat. No. 4,276,551, King U.S. Pat. No. 4,277,787, Lopez U.S. Pat. No. 4,191,960, Malm U.S. Pat. No. 4,189,733, Frazita U.S. Pat. No. 4,188,633, Reudink et al. U.S. Pat. No. 4,166,274, Steudel U.S. Pat. No. 4,160,975, and Piesinger U.S. Pat. No. 4,079,379.

SUMMARY OF THE INVENTION

An object of this invention is to provide a method for phase tuning to eliminate or reduce the errors in the tuning resulting from errors in the command versus actual phase characteristics of the individual phase shifters.

In the tuning technique according to the invention, a "sum tune" method is used, in which the same phase modulation is applied to all of the elements that are *not* being tuned, and the element being tuned does not have the modulation applied.

BRIEF DESCRIPTION OF THE DRAWING

FIG. 1 is a functional block diagram of a phased array antenna system;

FIG. 2 is a symbolic sketch of an antenna array for monopulse;

FIGS. 3 and 4 are block diagrams showing apparatus used with FIG. 1 for dynamic tuning with phaser modulation;

FIG. 7 is a vector diagram like that in FIG. 5;

FIG. 8 is a diagram of the output waveform of a detector output as might appear on an oscilloscope; and FIGS. 9 and 10 are a vector diagram showing sum tuning according to the invention.

DETAILED DESCRIPTION

Figure 5:
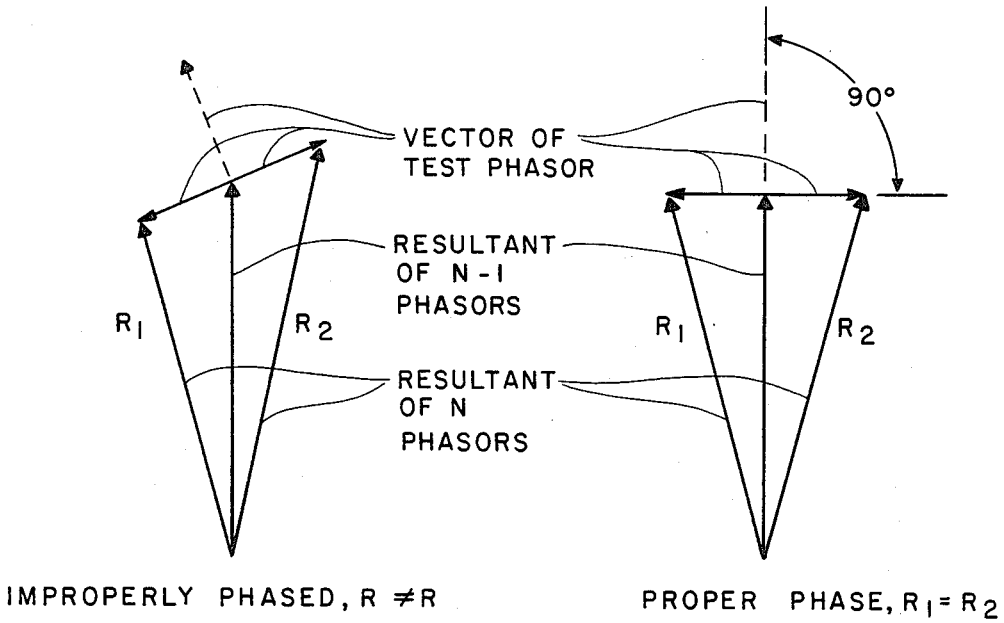
FIG. 5 is a vector diagram for the dynamic tuning with phaser modulation.

The sum tuning method may be best understood by tracing its evolution.

Phased Array System

FIG. 1 is a functional block diagram of a typical phased array system, such as might be used for a tracking radar. The antenna is shown as comprising N radiator elements designated 10-1 to 10-N. This may be a one-axis or linear array, or a two-axis array with a plurality of rows. For monopulse radar, the antenna may comprise four quadrants, as shown in FIG. 2, in which case the block diagram of FIG. 1 represents one quadrant. However, a single beam steering controller 20 must supply phase control signals to all four quadrants. In normal operation, received signals are detected and supplied to the computer for tracking a target.

In FIG. 1, the transmit signal at line T, via a circulator 11, enters one end of a transmit manifold 12, which couples R.F. energy into N output lines 14-1 to 14-N. These lines are coupled respectively via phasers 18-1 to 18-N to the antenna elements 10-1 to 10-N. Received signals at the antenna elements 10-1 to 10-N also pass through the phasors 18-1 to 18-N, combine in the manifold 12, and pass via the circulator 11 to line R. The beam steering computer 20 supplies control signals via control lines to each of the phasors 18-1 to 18-N.

All of the R.F. lines in FIG. 1 are generally waveguides. The transmit and receive manifolds, the phasors, and the circulators are waveguide assemblies. The transmit manifold 12 is a configuration which acts as a power divider for transmit, and on receive manifold 12 is a power combiner. A system using a corporate manifold 12 divides the energy into equal parts, and the line lengths 14 are equal. However, a system may be designed with unequal line lengths, and a specified amplitude taper may be used in the manifold 12.

In operation, the transmit energy on line T enters one end of the transmit manifold, and is divided into N parts on lines 14-1 to 14-N. Line 14-1 enters one end of the phasor assembly 18-1. The transmitted signal is coupled into the phasor 18-1 where it receives a phase shift commanded by the beam steering controller 20. The phase-shifted signal is then radiated from the element 10-1. The energy on the other lines from the manifold 12 is also phase shifted and radiated from corresponding elements of the array.

Receive energy from antenna element 10-1 re-enters the phase shifter 18-1 where it receives the same phase shift as on transmit. Receive energy then enters one of the ports of the manifold 12, where all N signals are collected and output via circulator 11 to line R.

Original Tuning Method

A problem is that to maximize antenna bandwidth, the line lengths from each port of a manifold to the corresponding radiator must be equal to within a few electrical degrees (corporate manifold). Since this accuracy cannot be maintained in manufacturing, a "tuning" procedure is used when initially setting up the system, and sometimes during maintenance. In early versions of the system of FIG. 1, the waveguide included length adjustment sections (not shown) for transmit or receive adjustment, but now the phase error is merely measured and stored in the beam steering computer for use as compensating data for the phasor commands.

The original tuning procedure had been to disconnect all but one of the adjustable line lengths and substitute terminations so that this part of the line was terminated looking in from either direction. The remaining line length was adjusted so that a particular phase relation was obtained between the signal from the radiator and a reference signal from a signal source.

The transmit adjustment comprised supplying a signal from a signal source via line T to the manifold, and also supplying a reference signal from the same source to a separate antenna placed alongside the array 10. At a distance of 1600 ft. two receiving antennas were placed, with one for receiving energy from the array 10, and the other for receiving the reference signal from the separate antenna. These two receiving antennas were connected to a phase meter. The transmit adjustment had not been satisfactory due to lack of sufficient isolation of the two signal paths. Cross-polarization of the two paths was used but some cross-coupling was unavoidable. An enclosed line such as coaxial cable might have been used for the reference signal but differential expansion of the coax path and the air path could then influence the measurement.

The receive adjustment comprised supplying a signal from a signal source to a transmitting antenna placed 1600 ft. from the array 10. A separate reference receive antenna was placed alongside the array. A phase meter was coupled between the reference receive antenna and line 26 from the receive manifold. The receive adjustment could be performed relatively satisfactorily except for some difficulties with wind-induced vibration of the reference antenna.

Both transmit and receive tuning were time-consuming since parts had to be unbolted and rebolted each time another line was to be tuned. In practice, about 20 minutes was required to adjust one line on transmit or receive.

Another problem was that the equalizing method assumed negligible interaction of the terminated line being adjusted. Reflections from the manifold and mutual coupling between radiators could cause errors of unknown magnitude.

When the antenna is operated with the rest of the radar, the high power transmitted energy will heat the phasors and cause a steady state phase shift. Correction for this involved measuring the relative phase between the radiators with the highest and lowest power levels and interpolating phase corrections for all radiating elements on the basis of laboratory heating measurements.

Maintainability of a phase-scanned antenna installed in a radome on an aircraft poses severe difficulties. Failures of the phasor drive or the phasors themselves can only be monitored crudely from a remote location. Possible changes of the phase shift characteristics cannot easily be detected.

Dynamic Tuning with Phasor Modulation

As a solution to the above problems, W. A. Skillman in an unpublished Westinghouse internal report disclosed a method for performing antenna "tuning" in a dynamic fashion, utilizing the electronic phasors as part of the test equipment. Line length equalization is performed by modulating each phasor in turn and adjusting its associated line length by observing the amplitude of the modulation on the antenna main beam signal. Since no disassembly is required, the time was reduced from 8 hours to less than 1 hour. Since all radiators are active, the cross-coupling effects are accounted for in the tuning. The method may also be extended to tune or monitor tuning when the antenna is installed in a radome either on or off an aircraft. Thus, the effects of high power on the phasors may be monitored. The method can also be extended to perform on-line re-calibration of the phasors under transmitting conditions.

The procedure is illustrated in FIG. 3 for transmit tuning, and in FIG. 4 for receive tuning. In each of these figures, the block F1 represents the apparatus shown in FIG. 1, except that the array 10 is shown outside the box. Also a general purpose minicomputer may be used in place of the beam steering controller 20. In FIG. 3, a signal source 32 is coupled to the transmit line T, and at the far end of the range there is a receive antenna 34 coupled to an envelope detector 36, whose output may be observed on an oscilloscope 38. In FIG. 4, at the far end of the range a signal source 42 is coupled to a transmit antenna 44. The line R from the receive manifold is coupled to an envelope detector 46, whose output may be observed on an oscilloscope 48.

To adjust the transmit lines, the signal source 32 is applied to all radiator lines via the transmit manifold. The beam is statically aimed at the receiving antenna 34 at the far end of the range. One phasor is modulated and the line length adjusted so that the signal from this phasor is statically in-phase with the composite signal from the remaining unmodulated phasors.

Basically, this is performed by alternately modulating the phasor $\pm 90$ degrees from the static position, and equalizing the resultant vectors by nulling their difference. The zero degree, or unmodulated vector, is then in-phase with the resultant of the remaining $N-1$ phasors.

The vector diagram of FIG. 5 shows both improper and proper phasing conditions. The magnitudes of the resultant vectors $R_1$ and $R_2$ are observed on the oscilloscope 38 following amplitude detection of the received signal.

In practice, reversing the phase as described would lead to hysteresis problems. However, the selection of an electrical analog of the Fox phase shifter avoids this problem. In this type phase shifter, the phase shift is proportional to the rotation of the applied magnetic field so that the value of phase shift can increase (or decrease) indefinitely by continuously rotating the magnetic field. Therefore, the desired values of $\pm 90$ degrees can be obtained without hysteresis effects by using a continually increasing phase progression. The simplest progression is 0, 90, 180, 270, 360, 450, (90, 270, 450 . . . cannot be used since this would involve a field reversal which would cause hysteresis effects).

Figure 6:
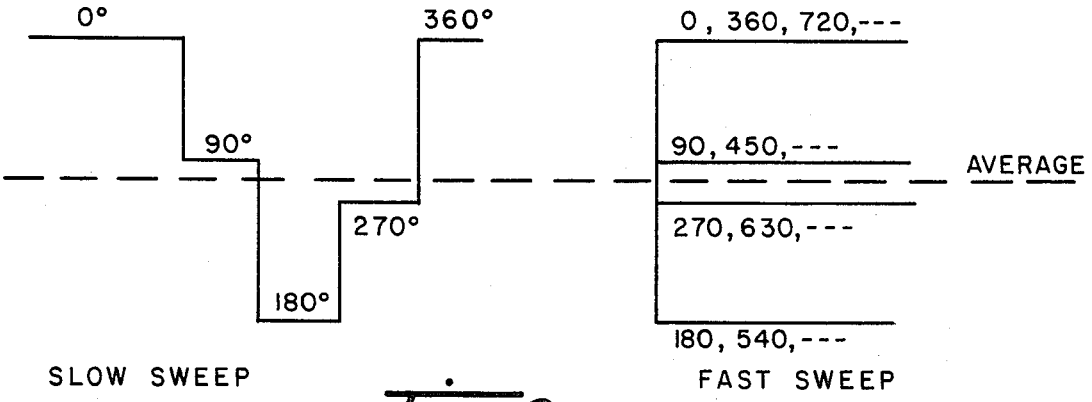
FIG. 6 shows oscilloscope diagrams associated with FIGS. 3–5.

Using the 90 degree modulation, the output of the envelope detector is shown in FIG. 6, as displayed on the oscilloscope.

On the slow sweep, it is seen that the 0 degree segment is longer. This is one form of coding that can be used to resolve the 90 degree ambiguity of the measurement.

Proper adjustment of phase is obtained when the 90 and 270 degree lines coincide on the oscilloscope. Each phasor 18-1 to 18-N in turn is modulated and the same null obtained.

Since the reference for the phase measurement changes phase slightly as each phasor is tuned by line length adjustments 19-1 to 19-N, the process must be iterated until the process converges.

Alternatives

As an alternate to mechanically adjusting for equal line lengths, the starting or 0 degree phase of the modulated phasor may be electronically shifted to obtain a null. The line length could then later be changed by a permanent increment (rather than using potentially troublesome tuners).

Monitoring of antenna tuning under operating conditions is a straightforward extension of the procedure disclosed above. When installed on an aircraft, the measurements must be done at short range using a small antenna installed somewhere on the aircraft. Considerable curvature of the phase front may occur. However, this can be found from the geometry and used to bias or correct the phasor under test, so that a null output is still required.

The oscilloscope is a convenient method of viewing the nulling process. However, the two voltages to be equalized could be converted to digital form and the difference displayed as a digital word.

The signal source could be gated on only during the 90, 270 degree segments. The resultant signal could then be nulled by means of a long time constant AC voltmeter.

Although the technique was described for a one dimensionally scanned array, it is readily adaptable to a two dimensionally scanned array.

A Fox type phasor is convenient to avoid hysteresis effects if a ferrite phase shifter is selected. If other types, such as diodes are used, the ±90 degrees modulation is sufficient without the intermediate states.

Amplitude Determination and Fault Diagnosis

For many years, the practicability of two-axis phased arrays has centered on their cost effectiveness in actual service. In virtually all airborne applications, cost considerations have led to the selection of more conventional antenna systems. A separate, but related problem arises when one considers the actual fabrication of a large phased array. It is essential, when dealing with a large array of independently controlled phase shift devices, to develop a means of quickly determining the operational status of each device. This particular requirement had been woefully unfulfilled in earlier development programs of large arrays.

An unpublished Westinghouse internal report disclosed by R. P. Gray, Jr., and D. K. Alexander provides a foundation for a number of array status self tests. The concept is derived from the computer-automated method used to initially phase-tune the array. Data obtained during the phasetune may be further processed, on a realtime basis, to provide a valuable data base for diagnosing the overall health of a phased array.

The method of FIGS. 3–6 has been modified in implementation and programming in order to adapt it to a dual axis array. The basic phase-tune vector diagram is relevant to the further development for amplitude determination and fault diagnosis. During a phase tune, the element to be tuned is phase modulated ±90° from its initial state while monitoring the amplitude modulation envelope. The initial state of the element is adjusted to minimize the magnitude of the modulation. The ultimate state so obtained is called the "tuned" phase state for that element and its value is retained.

The addition of one step during the phase process will yield significant additional information. Suppose that the initial state of the element is changed by 90° and the ±90° phase modulation again applied. The result is a second vector relationship and modulation envelope. The two amplitudes, $E_1$ and $E_2$, may be detected and measured. Using these quantities and the vector diagram the following relationships may be written.

$$E_1 = V \sin \theta$$
$$E_2 = V \cos \theta$$

Squaring and adding both equalities:

$$E_1^2 + E_2^2 = V^2 (\sin^2 \theta + \cos^2 \theta)$$

Finally:

$$V = \sqrt{E_1^2 + E_2^2}$$

Thus, we have a simple expression for the unknown element excitation (V) in terms of the measurable quantities, $E_1$ and $E_2$.

The improvement has been implemented and used extensively on a two-axis phased array antenna. During range test (including phase tune), the antenna is under the control of a general purpose minicomputer. Thus, straightforward programming steps are used to implement the phase modulation, process the data, and store voltage excitation values for all the array elements. A printout is obtained of the relative voltage excitations for one quadrant of the aforementioned array. Using these excitations as a data base, a great deal can be told about the condition and status of the antenna.

As pointed out earlier, the detected signal, used to derive the excitation values, is the result of phase modulating the element in question. If a particular phase shifter is inoperative, no phase modulation occurs ($E_1 = E_2 = 0$) and an excitation value of zero is obtained for that location. Thus, the location of phase shifter failures is discernible on the amplitude printout by the appearance of zero voltages. Because the procedure involves varying a small vector (one element) in the presence of a very large vector (the sum of all remaining elements), the signal detection is noise limited. Therefore, the failed elements are represented by relatively small, but not necessarily zero, excitation values. Thus, phase shifter failures may be ascertained by noting the remaining small voltage readings.

One additional step of data processing makes the process of detecting phase shifter failures much easier. Suppose we compare the measured element voltages with the computed or theoretical value at each location. Specifically, the following computation may be performed.

$$\% \text{ amplitude error} = \frac{V_{measured} - V_{theoretical}}{V_{theoretical}} \times 100$$

This provides a better basis for determining phase shifter failures because the impact of the intentional aperture amplitude function is taken into account. The situation becomes even clearer when all element locations having an amplitude error below some selected threshold are assigned the value zero. Experience has shown a 50% threshold to be an appropriate value for designating phase shifter failures.

Review and Problem

As described above, a method of electronically phase tuning has previously been developed. This method has been applied under computer control to automatically phase tune both single and dual axis arrays. Further extension of this method has been applied to determine element amplitudes and to provide fault-diagnosis.

The present invention proposes a change in the method of phase tuning an element to eliminate the errors in the tune resulting from errors in the command vs actual phase characteristics of the individual phase shifters.

The original method applied a ±90° phase modulation to the element being tuned. The resultant phasor diagram is shown in FIG. 7. In this figure:

$\overline{E}_i$=element phasor $=A_i e^{j\phi i}$ $A_i$=relative amplitude of the $i^{th}$ element $\phi_i$=element phase error $\overline{T}(\theta)$=the total phasor sum when the modulation is at the phase state $\theta$ $S_i=T_i-E_i$ The signal of FIG. 7 is then fed to a video detector. The detector response is proportional to the magnitude of the resultant phasor at the +90 and −90 states. If the DC component of the detector output is removed, the signal waveform of FIG. 8 is obtained. Here, the amplitude of the detected square wave ($V_m$) is proportional to $\overline{T}_i(90)-\overline{T}_i(-90)$. The "tuned" condition for the $i^{th}$ element occurs when $\overline{E}_i$ is aligned with $\overline{S}_i$ making $\overline{T}_i(90)=T_i(-90)$ and a null is observed at the output of the detection circuitry.

Note, however, that this original "element" tune method assumes that the element phase shifter is perfect in the sense that a 90° change in command causes an actual 90° rotation of $\overline{E}_i$. Actual phase shifters deviate from this ideal considerably. Even the highly accurate rotary field Fox phase shifters have single cycle ripple errors which can cause errors of ±1° at the ±90° states. Diode phase shifters or latched ferrite phase shifters are typically worse and include quantization effects.

Phase errors in the ±90° states will, in general, lead to imprecise alignment of the element vector and the ensemble sum at the "tuned" condition. Thus, although the tuning circuitry indicates a nulled or tuned condition, phase errors in the amount of the vector misalignment will be incurred. The tune process will quickly converge to reduce large errors and then fluctuate about the desired tune states with phase errors caused by the errors in the modulation states. After each element is tuned, its contribution to $\overline{S}_i$ changes with the result that significant systematic errors are also possible.

Sum Tuning

The new tuning technique which is the subject of the present patent application removes these error sources by applying the same phase modulation to all the elements that are *not* being tuned and is referred to as a "sum tune". Note that, with the sum tune, the element being tuned does not have modulation applied.

The phaser diagram for the sum tune process is shown in FIG. 9

As before, the output of the video detector is proportional to the magnitude of the resultant phasors $\overline{T}_i(90)$ and $\overline{T}_i(-90)$. By comparing FIGS. 7 and 9 and noting the identical triangles, it may be concluded that the primed and unprimed phasors have the same magnitude. Thus, the sum tune process results in the same square wave video output signals as the element tune.

With the sum tune process, the phaser sums at the ±90° states are now averaged for all states of the individual elements. The averaging process reduces the resultant error in these states, the improvement approaching a theoretical limit of $N^{\frac{1}{2}}$, where N is the number of tunable elements.

The sum tuning method provides an order of magnitude decrease in residual phase errors, and the same reduction in errors of the measured elements amplitude.

FIG. 9 and 10 show the phasor diagram of phase modulation results with sum tuning of an array of N elements, with FIG. 9 showing an untuned condition and FIG. 10 a tuned condition. The symbols are as follows:

$A_i$=relative amplitude of the $i^{th}$ element $\phi_i$=element phase error with respect to a uniform phase front $\overline{T}(\theta)$=the total array phasor sum when the modulation is at an angle $\theta$.

$S_i e^{j\theta}=T(\theta)-A_i e^{j\psi i}$

The phase modulation, $\theta$, is achieved by adding the phase $\theta$ to the phase of all the elements except the element being tuned. This results in the phasors $S_i e^{j\pi/2}$ and $S_i e^{-j\pi/2}$ having an accurate position in relation to the phasors $A_i e^{j\phi i}$. The accuracy is achieved since phase and amplitude errors present in the other elements have minimal effect when averaged over a large number of elements.

When the signal represented by the phasor diagram of FIG. 9 is passed through an envelope detector, the resulting video is a square wave with an amplitude proportional to the difference between $\overline{T}(\pi/2)$ and $\overline{T}(-\pi/2)$. By adjusting $\phi_i$ until the video amplitude is zero, the phasor $A_i e^{j\phi i}$ is tuned to the rest of the array. When the element is tuned, the phasor diagram of FIG. 10 is obtained with a tune angle of $\psi_i$.

In summary, sum tuning is an improved method for phase tuning a phased array antenna. The new method maintains a stable phase reference thoughout the procedure by using the non-updated ensemble vector sum to provide the modulation prior to detection. In this way, phase errors in individual phase shifters and long term errors associated with continuous updating are effectively eliminated.

Thus, while preferred constructional features of the invention are embodied in the structure illustrated herein, it is to be understood that changes and variations may be made by the skilled in the art without departing from the spirit and scope of my invention.

I claim:

1. A method of phase tuning a phased array antenna system comprising a plurality of antenna elements, with each element coupled to a transmission line including a phase shift device individual to that element, said method comprising the steps (a) supplying a signal which is divided to said transmission lines;

(b) phase modulating all of the phase shift devices except for the phase shift device of one element being tuned, the modulation being effectively plus and minus ninety degrees;

(c) the signal being radiated from the array and received by a test antenna placed a predetermined distance from the array and applied to an envelope detector;

(d) analyzing the envelope as detected by said envelope detector and adjusting the effective electrical length of the transmission line or phase shift for said one element being tuned to obtain a null of said envelope; and (e) the steps (a) to (d) being repeated for tuning each of said elements.

2. The method according to claim 1, in which the output of the envelope detector is digitized and supplied to a computer, which automatically adjusts the phase shift device of the element being tuned until a null is obtained.

3. A method of phase tuning a phased array antenna system comprising a plurality of antenna elements, with each element coupled to a transmission line including a phase shift device individual to that element, said method comprising the steps (a) transmitting a signal from a test antenna placed a predetermined distance from the array;

(b) the signal being received at the array, routed via said transmission lines, combined, and applied to an envelope detector;

(c) phase modulating all of the phase shift devices except for the phase shift device of one element being tuned, the modulation being effectively plus and minus ninety degrees;

(d) analyzing the envelope as detected by said envelope detector and adjusting the effective electrical length of the transmission line or phase shift for said one element being tuned to obtain a null of said envelope; and (e) the steps (a) to (d) being repeated for tuning each of said elements.

4. The method according to claim 3, in which the output of the envelope detector is digitized and supplied to a computer, which automatically adjusts the phase shift device of the element being tuned until a null is obtained.

* * * * *